US006348075B1

(12) United States Patent
Jackson

(10) Patent No.: US 6,348,075 B1
(45) **Date of Patent: *Feb. 19, 2002**

(54) COMPOSITIONS CONTAINING POLYALKENE-SUBSTITUTED AMINE AND POLYETHER ALCOHOL

(75) Inventor: Mitchell M. Jackson, Chagrin Falls, OH (US)

(73) Assignee: The Lubrizol Corporation, Wickliffe, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/059,945

(22) Filed: Apr. 14, 1998

(51) Int. Cl.[7] ..... C10L 1/18; C10L 1/22
(52) U.S. Cl. ..... 44/432; 44/443
(58) Field of Search ..... 44/412, 432, 443; 508/558, 579

(56) References Cited

U.S. PATENT DOCUMENTS

| | | | | | |
|---|---|---|---|---|---|
| 3,658,494 | A | * | 4/1972 | Dorer, Jr. | 44/443 |
| 3,901,665 | A | | 8/1975 | Polss | 44/398 |
| 4,877,416 | A | * | 10/1989 | Campbell | 44/412 |
| 5,004,478 | A | | 4/1991 | Vogel et al. | 44/398 |
| 5,006,130 | A | * | 4/1991 | Aiello et al. | 44/432 |
| 5,298,039 | A | | 3/1994 | Mohr et al. | 44/443 |
| 5,522,906 | A | | 6/1996 | Hashimoto et al. | 44/400 |
| 5,697,988 | A | | 12/1997 | Malfer et al. | 44/415 |
| 5,993,499 | A | * | 11/1999 | Houser | 44/412 |

FOREIGN PATENT DOCUMENTS

| | | |
|---|---|---|
| EP | 0 374 461 A1 | 6/1990 |
| EP | 0 505 070 A1 | 9/1992 |
| EP | 0 548 617 A2 | 6/1993 |
| EP | 0 704 519 A1 | 4/1996 |

OTHER PUBLICATIONS

European Search Report dated Jul. 30, 1999 for European Application No. 99302911.5–2104.

* cited by examiner

*Primary Examiner*—Margaret Medley
*Assistant Examiner*—Cephia D. Toomer
(74) *Attorney, Agent, or Firm*—Jeffrey F. Munson; David M. Shold; Joseph P. Fischer

(57) ABSTRACT

The present invention is directed to a composition containing

A) at least one polyalkenene substituted amine; and

B) at least one hydrocarbyl-terminated poly (oxypropylene) monool represented by the formula (B-I)

wherein in formula (B-I), R is an alkyl or an alkyl-substituted aromatic group of about 8 to about 20 carbon atoms; x is a number from about 13 to about 28; and wherein the weight ratio of component (A) to component (B) ranges from about 10:1 to about 1:10.

The composition is useful as a fuel additive for reducing intake valve deposits or for improving the valve stick performance of an internal combustion engine. The invention also relates to concentrates and fuel compositions containing the foregoing fuel additive composition and to a method for reducing intake valve deposits or for improving the valve stick performance of an internal combustion engine.

11 Claims, No Drawings

COMPOSITIONS CONTAINING POLYALKENE-SUBSTITUTED AMINE AND POLYETHER ALCOHOL

BACKGROUND OF THE INVENTION

1. Field of the Invention

The present invention relates to compositions containing a polyalkene-substituted amine and a polyether alcohol. The present invention also relates to fuel compositions containing an intake valve deposit inhibiting amount of said composition.

2. Description of the Related Art

It is well known to those skilled in the art that internal combustion engines form deposits on the surface of engine components, such as carburetor ports, throttle bodies, fuel injectors, intake ports, and intake valves, due to the oxidation and polymerization of hydrocarbon fuel. Deposits also form in the combustion chamber of an internal combustion engine as a result of incomplete combustion of the mixture of air, fuel, and oil. These deposits, even when present in relatively minor amounts, often cause noticeable driving problems, such as stalling and poor acceleration. Moreover, engine deposits can significantly increase an automobile's fuel consumption and production of exhaust pollutants. Specifically, when the gasoline used in a given engine is of a constant octane number, the power output decreases when deposits are formed. In order to maintain the power output at a predetermined desired level, it then becomes necessary to increase the octane number of the fuel over the course of time. This Octane Requirement Increase (ORI) is undesirable. Therefore, the development of effective fuel detergents or deposit control additives to prevent or control such deposits is of considerable importance, and numerous such materials are known in the art.

Two general classes of additives are commercially known. One class comprises hydrocarbyl-substituted amines such as those derived from reacting halogenated olefin polymers and amines. Typical examples of this class are polybutenyl amines. Another class of additives comprises the polyetheramines. Usually, these are "single molecule" additives, incorporating both amine and polyether functionalities within the same molecule. A typical example is a carbamate product comprising repeating butylene oxide units under the trade name "Techron™" marketed by the Oronite Division of Chevron Chemical Company.

In some cases, the polyetheramines are preferred as the oxygenation (from the polyether functionality) is thought to lower particulate matter and nitrogen oxide (NOx) emissions and combustion chamber deposits. In addition, polyetheramines require little or no additional fluidizer to pass certain industry mandated valve stick requirements, resulting in a more economical final package. Polyisobutenyl amines, on the other hand, do require the addition of fluidizer to pass valve stick requirements and in addition are perceived to cause higher combustion chamber deposits than the fuel alone.

Valve sticking is an undesirable effect that can occur, particularly in cold weather conditions, if an improper or insufficient amount of fluidizer is used with the polybuteneamine. An important property of fuel additives, in addition to keeping the intake valves clean, is the retention of their basic mechanical function. Although deposit control agents based on polybuteneamines are effective in providing an excellent cleaning action to intake valves, these materials can be deposited in the course of time in the form of a thin layer on the valve head and valve stem (valve guide) of the intake valves, owing to their low volatility (high boiling point). Under certain driving conditions, and especially at low outside temperatures, the tacky layer may become so viscous that functioning of the valves is adversely affected. This may lead to compression losses in individual cylinders and, in unfavorable cases, to engine failure as a result of the valves sticking.

Hence, advantageous fuel additives are those which as a result of their cleaning effect, form completely desirable, thin protective films in the intake systems (valve head and valve stem); however, the viscosity of these protective films at low temperatures must not be too high or the protective films be too tacky so that engine failure occurs, i.e., the intake valves remain sticking as a result of the very tacky valve stem.

It has now been discovered that certain polyalkene-substituted amines in combination with certain polyether alcohols (hydrocarbyl-substituted poly(oxypropylene) monool) provide exceptional reduction in intake valve deposit formation. Although combinations of polyether alcohols and nitrogen compounds have been known in general to be useful as deposit control agents, the present compositions containing a certain class of polyether alcohols in combination with certain polyalkeneamines have been found to be particularly effective in providing an unexpected and synergistic improvement in the control of intake valve deposits. The present compositions have also been found to provide an unexpected improvement in valve stick performance (i.e., they do not cause intake valves to stick due to high viscosity at low temperature).

U.S. Pat. No. 5,298,039, Mohr et al., Mar. 29, 1994, discloses a composition comprising an internal combustion fuel and a combination of a) from 10 to 5,000 ppm of a nitrogen-containing detergent component which is or contains a polyisobutylamine and b) from 10 to 5,000 ppm of an alkoxylate of the following formula

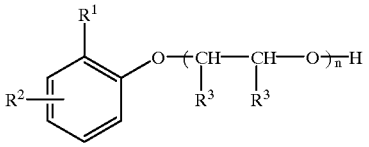

where $R^1$ and $R^2$ independently of one another are each branched or straight-chain $C_6$–$C_{30}$-alkyl, one of the two radicals $R^3$ is methyl and the other is hydrogen and n is from 1 to 100.

U.S. Pat. No. 4,877,416, Campbell, Oct. 31, 1989, discloses a fuel composition comprising a major portion of hydrocarbons boiling in the gasoline range and (a) from about 0.001% by weight to about 1.0% by weight of a hydrocarbyl-substituted amine or polyamine having an average molecular weight of about 750 to about 10,000 and also having at least one basic nitrogen atoms, and(b) a hydrocarbyl-terminated poly(oxyalkylene) monool having an average molecular weight from about 500 to about 5,000 wherein said oxyalkylene group of the hydrocarbyl-terminated poly(oxyalkylene) monool is a $C_2$ to $C_5$ oxyalkylene group and the hydrocarbyl group of said hydrocarbyl-terminated poly(oxyalkylene) monool is a $C_1$ to $C_{30}$ hydrocarbyl group and wherein the weight percent of the hydrocarbyl-terminated poly(oxyalkylene)monool in the fuel composition ranges from about 0.01 to 100 times the amount of hydrocarbyl-substituted amine or polyamine.

SUMMARY OF THE INVENTION

The present invention relates to a composition comprising (A) at least one polyalkenene-substituted amine; and (B) at least one hydrocarbyl-terminated poly(oxypropylene) monool represented by the formula (B-I)

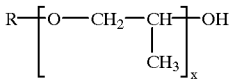

wherein in formula (B-I), R is an alkyl or alkyl-substituted aromatic group of about 8 to about 20 carbon atoms; x is a number from about 13 to about 28; and wherein the weight ratio of component (A) to component (B) ranges from about 10:1 to about 1:10.

The composition is useful as a fuel additive for reducing intake valve deposits or for improving the valve stick performance of an internal combustion engine. The invention also relates to concentrates and fuel compositions containing the foregoing fuel additive composition and to a method for reducing intake valve deposits or for improving the valve stick performance of an internal combustion engine by fueling an engine with a fuel composition containing the foregoing fuel additive composition.

DETAILED DESCRIPTION OF THE INVENTION

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic. (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and, sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The Polyalkene-substituted Amines (A)

The polyalkene-substituted amines (A) of this invention may be derived from an olefin polymer and an amine (ammonia, mono- or polyamine). They may be prepared by a variety of methods such as those described hereinafter.

One method of preparation involves reacting a halogenated olefin polymer with an amine, such as that disclosed in U.S. Pat. Nos. 3,275,554; 3,438,757; 3,454,555; 3,565,804; 3,755,433; and 3,822,289.

Another method involves reacting a hydroformylated olefin with a polyamine and hydrogenating the reaction product, as disclosed in U.S. Pat. Nos. 5,567,845 and 5,496,383.

Another method involves converting a polyalkene by means of a conventional epoxidation reagent with or without a catalyst, into the corresponding epoxide and converting the epoxide into the polyalkene substituted amine by reaction with ammonia or an amine under the conditions of reductive amination, as disclosed in U.S. Pat. No. 5,350,429.

Another method for preparing polyalkene substituted amine involves hydrogenation of a β-aminonitrile which is made by reacting an amine with a nitrile as disclosed in U.S. Pat. No. 5,492,641.

The above methods for the preparation of polyalkene substituted amine are for illustrative purposes only and are not meant to be an exhaustive list. The polyalkene-substituted amines of the present invention are not limited in scope to the methods of their preparation disclosed hereinabove.

In one embodiment, the olefin polymers used to make the polyalkene-substituted amine of the present invention are derived from olefin polymers. The olefin polymers include homopolymers and interpolymers of polymerizable olefin monomers of 2 to about 16 carbon atoms, and in one embodiment from 2 to about 6 carbon atoms, and in one embodiment from 2 to about 4 carbon atoms. The interpolymers are those in which two or more olefin monomers are interpolymerized according to well known conventional procedures to form polyalkenes having units within their structure derived from each of said two or more olefin monomers. Thus "interpolymer(s)" as used herein is inclusive of copolymers, terpolymers, and tetrapolymers. As will be apparent to those of ordinary skill in the art, the polyalkenes from which the polyalkene-substituted amines (A) are derived are often conventionally referred to as "polyolefin(s)".

The olefin monomers from which the olefin polymers are derived include polymerizable olefin monomers characterized by the presence of one or more ethylenically unsaturated groups (i.e., >C═C<); that is they are monoolefinic monomers such as ethylene, propylene, 1-butene, isobutene (2-methyl-1-butene), 1-octene or polyolefinic monomers (usually diolefinic monomers) such as 1,3-butadiene and isoprene.

The olefin monomers are usually polyrqerizable terminal olefins; that is, olefins characterized by the presence in their structure of the group >C═$CH_2$. However, polymerizable internal olefin monomers characterized by the presence within their structure of the group

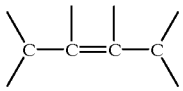

can also be used to form the polyalkenes.

Specific examples of terminal and internal olefin monomers which can be used to prepare the polyalkenes according to conventional, well-known polymerization techniques include ethylene; propylene; the butenes (butylenes), including 1-butene, 2-butene and isobutene; 1-pentene; 1-hexene; 1-heptene; 1-octene; 1-nonene; 1-decene; 2-pentene; propylene-tetramer; diisobutylene; isobutylene trimer; 1,2-butadiene; 1,3-butadiene; 1,2-pentadiene; 1,3-pentadiene;

1,4-pentadiene; isoprene; 1,5-hexadiene; 2-methyl-5-propyl-1-hexene; 3-pentene; 4-octene, and 3,3-dimethyl-1-pentene.

In one embodiment the olefin polymer is obtained by polymerization of a $C_4$ refinery stream having a butene content of about 35 to about 75 weight percent and isobutene content of about 30 to about 60 weight percent, in the presence of a Lewis acid catalyst such as aluminum trichloride or boron trifluoride. These polybutenes typically contain predominantly (greater than about 80% of total repeating units) isobutene repeating units of the configuration

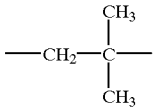

The amines that can be used include ammonia, monoamines, polyamines, or mixtures of two or more thereof, including mixtures of different monoamines, mixtures of different polyamines, and mixtures of monomamines and polyamines (which include diamines). The amines include aliphatic, aromatic, heterocyclic and carbocyclic amines.

The monoamines and polyamines are characterized by the presence within their structure of at least one H—N< group. Therefore, they have at least one primary (i.e.,$H_2N$—) or secondary amine (i.e., 1 H—N<) group. The amines can be aliphatic, cycloaliphatic, aromatic or heterocyclic.

The monoamines are generally substituted with a hydrocarbyl group having 1 to about 50 carbon atoms. Preferably these hydrocarbyl groups are aliphatic and free from acetylenic unsaturation and contain 1 to about 30 carbon atoms. Saturated aliphatic hydrocarbon radicals containing 1 to about 30 carbon atoms are particularly preferred.

In one embodiment, the monoamines can be represented by the formula $HNR^1R^2$ wherein $R^1$ is a hydrocarbyl group of up to about 30 carbon atoms and $R^2$ is hydrogen or a hydrocarbyl group of up to about 30 carbon atoms. Examples of suitable monoamines include ethylamine, diethylamine, n-butylamine, di-n-butylamine, allylamine, isobutylamine, cocoamine, stearylamine, laurylamine, methyllaurylamine, and oleylamine.

Aromatic monoamines include those monoamines wherein a carbon atoms of the aromatic ring structure is attached directly to the amine nitrogen. The aromatic ring will usually be a mononuclear aromatic ring (i.e., one derived from benzene) but can include fused aromatic rings, especially those derived from naphthalene. Examples of aromatic monoamines include aniline, di(paramethylphenyl) amine, naphthylamine, and N-(n-butyl)aniline. Examples of aliphatic substituted, cycloaliphatic-substituted, and heterocyclic-substituted aromatic monoamines include para-dodecylaniline, cyclohexyl-substituted naphthylamine, and thienyl-substituted aniline respectively.

Hydroxy amines are also included in the class of useful monoamines. Such compounds are the hydroxyhydrocarbyl-substituted analogs of the aforementioned monoamines. In one embodiment the hydroxy monoamines can be represented by the formula $HNR^3R^4$, wherein $R^3$ is an alkyl or hydroxysubstituted alkyl radical of up to about 30 carbon atoms, and in one embodiment up to about 10 carbon atoms, and $R^4$ is hydrogen or a hydrocarbyl group of up to about 10 carbon atoms.

Suitable hydroxy-substituted monoamines include ethanolamine, di-3-propanolamine, 4-hydroxybutylamine, diethanolamine, and N-methyl-2-propylamine.

The amine can also be a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

The alkylene polyamines include those represented by the formula

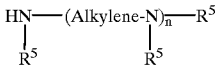

wherein n ranges from 1 to about 10, and in one embodiment from 2 to about 7, and in one embodiment from 2 to about 5, and the "Alkylene" group has from 1 to about 10 carbon atoms, and in one embodiment from 2 to about 6, and in one embodiment from 2 to about 4 carbon atoms. $R^5$ is independently hydrogen, aliphatic, hydroxy- or amine-substituted aliphatic group of up to about 30 carbon atoms. Preferably $R^5$ is H or lower alkyl (an alkyl group of 1 to about 5 carbon atoms), most preferably, H. Such alkylene polyamines include methylene polyamine, ethylene polyamines, butylene polyamines, propylene polyamines, pentylene polyamines, hexylene polyamines and heptylene polyamines. The higher homologs of such amines and related aminoalkyl-substituted piperazines are also included.

Specific alkylene polyamines useful in preparing the polyalkene-substituted amines of this invention include ethylene diamine, diethylene triamine, triethylene tetramine, tetraethylene pentamine, propylene diamine, 3-dimethylaminopropylamine, trimethylene diamine, hexamethylene diamine, decamethylene diamine, octamethylene diamine, di(heptamethylene)triamine, tripropylene tetramine, pentaethylene hexamine, di(trimethylene triamine), N-(2-aminoethyl)piperazine, and 1,4-bis(2-aminoethyl)piperazine.

Ethylene polyamines, such as those mentioned above, are especially useful for reasons of cost and effectiveness. Such polyamines are described in detail under the heading "Diamines and Higher Amines" in the Encyclopedia of Chemical Technology, Second Edition, Kirk and Othemer, Volume 7, pages 27–39, Interscience Publishers, Division of John Wiley and Sons, 1965. Such compounds are prepared most conveniently by the reaction of an alkylene chloride with ammonia or by reaction of an ethylene imine with a ring-opening reagent such as ammonia. These reactions result in the production of the somewhat complex mixtures of alkylene polyamines, including cyclic condensation products such as piperazines.

Other useful types of polyamine mixtures are those resulting from stripping of the above-described polyamine mixtures to leave as residue what is often termed "polyamine bottoms". In general, alkylenepolyamine bottoms can be characterized as having less than two, usually less than 1% (by weight) material boiling below about 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably DETA), 0.72% TETA, 21.74% tetraethylene pentamine and 76.61% pentaethylenehexamine and higher (by weight). These alkylenepolyamine bottoms include cyclic condensation products such as piperazine and higher analogs of diethylenetriamine, triethylenetetramine and the like.

The hydroxy containing polyamines include hydroxyalkyl alkylene polyamines having one or more hydroxyalkyl substituents on the nitrogen atoms. Such polyamines may be made by reacting the above-described alkylenepolyamines with one or more of alkylene oxides (e.g., ethylene oxide, propylene oxide, and butylene oxide). Similar alkylene oxide-alkanolamine reaction products may also be used such as the products made by reacting primary, secondary or tertiary alkanolamines with ethylene, propylene or higher epoxides in a 1:1 to 1:2 molar ratio. Reactant ratios and temperatures for carrying out such reactions are known to those skilled in the art.

Preferred hydroxyalkyl-substituted alkylene polyamines are those in which the hydroxyalkyl group is a lower hydroxyalkyl group, i.e., having less than eight carbon atoms. Examples of such hydroxyalkyl substituted polyamines include N-(2-hydroxyethyl)ethylene diamine (also known as 2-(2-Aminoethylamino)ethanol), N,N-bis(2-hydroxyethyl)ethylene diamine, 1-(2-hydroxyethyl) piperazine, monohydroxypropyl-substituted diethylene triamine, dihydroxypropyl-substituted tetraethylene pentamine, and N-(3-hydroxybutyl)tetramethylene diamine.

The arylpolyamines are analogous to the aromatic monoamines mentioned above except for the presence within their structure of another amino nitrogen. Some example of arylpolyamines include N,N'-di-n-butyl-paraphenylene diamine and bis-(para-aminophenyl) methane.

The heterocyclic mono- and polyamines include aziridines, azetidines, azolidines, pyridines, pyrroles, indoles, piperidines, imidazoles, piperazines, isoindoles, purines, morpholines, thiomorpholines, N-amninoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, and N-hydroxyethylpiperazine.

Examples of polyalkene substituted amines include poly (propylene)amine; N-poly(butene)amine; N-polybutenemorpholine; N-poly(butene)ethylenediamine; N-poly(propylene)trimethylenediamine; N-poly(butene) diethylenetriamine; N',N'-poly(butene) tetraethylenepentamine; and N,N-dimethyl-N'poly (propylene)-1,3-propylenediamine. The number average molecular weight of the polyalkene substituted amines will typically range from about 500 to about 3000, and in one embodiment from about 1000 to about 1500.

The Hydrocarbyl-terminated Poly(oxypropylene) Monool (B)

The second component of the present inventive composition is a hydrocarbyl-terminated poly(oxypropylene) monool represented by the formula (B-I)

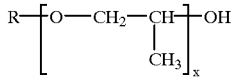

wherein in formula (B-I), R is an alkyl or alkyl-substituted aromatic group of about 8 to about 20 carbon atoms, and in one embodiment about 12 to about 16 carbon atoms; and x is a number from about 13 to about 28, and in one embodiment from about 15 to about 17, and in one embodiment from about 21 to about 25, and in one embodiment from about 21 to about 23 and in one embodiment from about 23 to about 25 carbon atoms. The alkyl group (R) can be linear or branched. In one embodiment, R is a tridecyl group represented by the formula

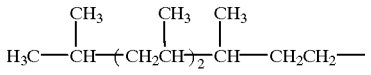

In one embodiment R is a linear alkyl group of about 12 to about 15 carbon atoms.

The hydrocarbyl-terminated poly(oxypropylene) monool of this invention can be made by the addition of propylene oxide to the alcohol ROH under polymerization conditions, wherein R is the hydrocarbyl group which caps the poly (oxypropylene) chain. Methods of production and properties of poly(oxyalkylene) polymers are disclosed in U.S. Pat. Nos. 2,841,479 and 2,782,240 and in Kirk-Othemer's "Encyclopedia of Chemical Technology", Volume 19, p. 507.

The weight ratio of the polyalkene substituted amine (A) to the hydrocarbyl-terminated poly(oxypropylene) monool (B) ranges from about 10:1 to about 1:10, and in one embodiment from about 5:1 to about 1:5, and in one embodiment from about 2:1 to about 1:2.

The fuel compositions of the present invention contain a major proportion (at least 90% by weight; more preferably at least 95% by weight) of a normally liquid fuel, usually a hydrocarbonaceous petroleum distillate fuel such as motor gasoline as defined by ASTM Specification D439 and diesel fuel or fuel oil as defined by ASTM Specification D396. Normally liquid fuel compositions comprising non-hydrocarbonaceous materials such as alcohols, ethers, organo-nitro compounds (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more non-hydrocarbonaceous materials are also contemplated. Examples of such mixtures, are combinations of gasoline and ethanol and of diesel fuel and ether.

Oxygen containing molecules (oxygenates) are compounds covering a range of alcohol and ether type compounds. They have been recognized as means for increasing octane value of a base fuel. They have also been used as the sole fuel component, but more often as a supplemental fuel used together with, for example, gasoline, to form the well-known "gasohol" blend fuels. Oxygenated fuel (i.e. fuels containing oxygen-containing molecules) are described in ASTM D-4814-91. The oxygenated fuel of this invention will typically comprise up to 25% by weight of one or more oxygen-containing molecules.

Methanol and ethanol are the most commonly used oxygen-containing molecules. Other oxygen-containing molecules, such as ethers, for example methyl-t-butyl ether, are more often used as octane number enhancers for gasoline.

Particularly preferred normally liquid fuels are gasoline, that is, a mixture of hydrocarbons having an ASTM boiling point of 60° C. at the 10% distillation point to about 205° C. at the 90% distillation point, oxygenates, and gasoline-oxygenate blends, all as defined in the aforementioned ASTM Specifications for automotive gasolines. Most preferred is gasoline.

The fuel composition of the present invention contains a minor intake valve deposit inhibiting amount or valve stick performance enhancing amount of the composition of the present invention (the composition comprising components (A) and (B) as described hereinbefore, which can be considered to be a fuel additive).

Valve stick performance can be measured by the Volkswagen Waterboxer test, as detailed in the "Examples" section of the specification, or by other similar test. Usually the intake valve deposit inhibiting or valve stick performance enhancing amount is about 10 to about 5000 parts, and in one embodiment about 50 to about 1000 parts, and in one embodiment about 100 to about 400 parts per million parts by weight of the normally liquid fuels.

In one embodiment of the fuel composition of the present invention, components (A) and (B) of the present inventive composition are each present at a level of about 50 to about 250, and in one embodiment about 50 to about 200 parts per million parts by weight of the normally liquid fuel.

Treating levels of the fuel additives used in this invention are often described in terms of parts per million (by weight) (ppm) or pounds per thousand barrels (ptb) of fuel. The ptb values may be multiplied by four to approximately convert the number to ppm.

The fuel compositions of the present invention can contain other additives which are well known to those of skill in the art. These can include anti-knock agents such as tetra-alkyl lead compounds, lead scavengers such as haloalkanes, dyes, antioxidants such as hindered phenols, rust inhibitors such as alkylated succinic acids and anhydrides and derivatives thereof, bacteriostatic agents, auxiliary dispersants and detergents, gum inhibitors, fluidizers, metal deactivators, demulsifiers, and anti-icing agents. The fuel compositions of this invention can be lead-containing or lead-free fuels. Preferred are lead-free fuels.

The compositions of this invention can be added directly to the fuel, or they can be diluted with a substantially inert, normally liquid organic diluent such as naphtha, benzene, toluene, xylene or a normally liquid fuel as described above, to form an additive concentrate. These concentrates generally contain from about 10% to about 90% by weight of the composition of this invention and may contain, in addition one or more other conventional additives known in the art or described hereinabove.

EXAMPLES

The examples below illustrate that the combination of (A) polybuteneamine and (B) certain hydrocarbyl-terminated poly(oxypropylene) monools reduce intake valve deposits or reduce the occurrence of valve sticking (i.e. improving valve sticking performance) in an internal combustion engine.

Table 1 discloses the different hydrocarbyl-terminated poly(oxypropylene) monools used in the compositions tested.

The hydrocarbyl-terminated poly(oxypropylene) monools below correspond to those of the formula

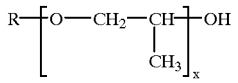

(B-I)

wherein in formula (B-I), R is the hydrocarbyl group of the initiating alcohol used to make the hydrocarbyl-substituted poly(oxypropylene) monool, and x is the number of repeat units of the propylene oxide.

TABLE 1

Description of polyether alcohols

| Hydrocarbyl-terminated Poly(oxypropylene) monool | R | x |
|---|---|---|
| I[a] | ~$C_{12-16}$ alkyl | 9–11 |
| II | Nonylphenyl | 13–15 |
| III | Nonylphenyl | 21–23 |
| IV[b] | $C_{12-15}$ alkyl | 23–25 |

[a]Emkarox ™ AF-20 (ICI)
[b]Actaclear ™ ND-21 (Arco Chemicals)

Table 2 below discloses engine test data showing the amount of intake valve deposit for base fuel and for the two different hydrocarbyl-terminated poly(oxypropylene) monools of Table 1 in combination with a polybuteneamine.

TABLE 2

Intake Valve Deposit Results

| Hydrocarbyl-terminated poly(oxypropylene) monool | Conc. (ppm) | Polybuteneamine[2] Conc. (ppm) | Intake Valve Deposits (mg) |
|---|---|---|---|
| | | | Ford 2.3L[3] |
| None[1] | 0 | 0 | 392 |
| I | 50 | 100 | 139 |
| III | 50 | 100 | 46 |
| | | | GM 3.1L[4] |
| None | 0 | 0 | 219 |
| I | 80 | 156 | 221 |
| III | 160 | 104 | 61 |

[1]Base fuel
[2]N-poly(butene)ethylenediamine; Mn~1300
[3]100 hr. Ford 2.3L dynamometer test
[4]112 hr. GM 3.1L dynamometer test The data in Table 2 shows that the composition utilizing the hydrocarbyl-terminated poly(oxypropylene)monool with the higher number of oxypropylene repeat units (21–23 repeat units) performs better (gives rise to a much lower amount of deposit) than either the base fuel alone or the composition utilizing the poly(oxypropylene) monool with the lower number of oxypropylene repeat units (9–11 repeat units).

Table 3 below discloses test results from the well-known Volkswagen Waterboxer Inlet Valve Sticking Test, using test procedure CEC F-16-T-96. This is a standard test well known to those skilled in the art for measuring the valve stick performance of a fuel composition. The low temperature profile is at 5° C. (41° F.), the duration is 3 cycles (days) and the results are based on the compression pressure for each of the 4 cylinders each day. Thus the number of cylinders with compression loss can range from 0 to 12, 0 being the most desirable, and 12 being the least desirable.

TABLE 3

Valve Sticking Test Results

| Hydrocarbyl-terminated poly(oxypropylene) monool | Conc. (ppm) | Polybuteneamine[2] Conc. (ppm) | # Cylinders with compresion losses |
|---|---|---|---|
| I | 107 | 211 | 7 |
| II | 107 | 211 | 1 |
| IV | 107 | 211 | 0 |

The results indicate that the compositions utilizing the hydrocarbyl-terminated poly(oxypropylene)monool with the higher number of oxypropylene repeat units (13–15 repeat units (polyether II), and 23–25 repeat units (polyether IV)) perform better (have fewer cylinders that lose compression) than the composition utilizing the poly (oxypropylene) monool with the lower number of oxypropylene repeat units (9–11 repeat units; polyether I).

Each of the documents referred to above is incorporated herein by reference. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the amount, range, and ratio limits set forth herein may be combined. As used herein, the expression "consisting essentially of" permits the inclusion of substances which do not materially affect the basic and novel characteristics of the composition under consideration.

What is claimed is:

1. A composition comprising:

(A) a polyisobutylene-substituted ethylenediamine having a number average molecular weight of about 1000 to about 1500; and (B) a hydrocarbyl-terminated poly(oxypropylene) monool represented by the formula

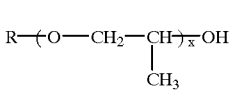

(B-I)

wherein R is an alkyl group of about 12 to about 16 carbon atoms, x is about 23 to about 25, and wherein the weight ratio of component (A) to component (B) is about 1:2 to about 2:1.

2. The composition of claim 1 wherein the polyisobutylene-substituted ethylenediamine (A) is derived from reacting a halogenated olefin polymer with ethylenediamine.

3. The composition of claim 1 wherein in formula (B-I), R is a tridecyl group represented by the formula

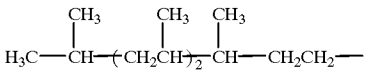

4. The composition of claim 1 wherein in formula (B-I), R is a linear alkyl group of about 12 to about 15 carbon atoms.

5. A concentrate comprising about 10% to about 90% by weight of an organic diluent and the composition of claim 1.

6. A fuel composition comprising a major amount of a normally liquid fuel and a minor intake valve deposit-inhibiting or valve stick performance-enhancing amount of an additive composition comprising:

(A) a polyisobutylene-substituted ethylenediamine having a number average molecular weight of about 1000 to about 1500; and (B) a hydrocarbyl-terminated poly(oxypropylene) monool represented by the formula

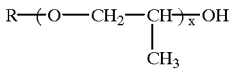

(B-I)

wherein R is an alkyl group of about 12 to 16 carbon atoms, x is about 23 to about 25, wherein components (A) and (B) are each present at a level of about 50 to about 250 ppm based on the weight of the normally liquid fuel, and wherein the weight ratio of component (A) to component (B) is about 1:2 to about 2:1.

7. The composition of claim 6 wherein the normally liquid fuel is gasoline.

8. A method for fueling an internal combustion engine, comprising fueling said engine with the fuel composition of claim 6.

9. A method for reducing the intake valve deposits or improving the valve stick performance of an internal combustion engine, comprising fueling said engine with the fuel composition of claim 6.

10. A composition comprising:

(A) a polyisobutylene-substituted alkylene polyamine having a number average molecular weight of about 1000 to about 1500, wherein the alkylene polyamine is selected from the group consisting of ethylenediamine, diethylenetriamine, triethylenetetramine, tetraethylenepentamine, and pentaethylenehexamine and mixtures thereof; and (B) a hydrocarbyl-terminated poly(oxypropylene) monool represented by the formula

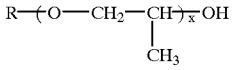

(B-I)

wherein R is an alkyl group of about 12 to about 16 carbon atoms, x is about 23 to about 25, and wherein the weight ratio of component (A) to component (B) is about 1:2 to about 2:1.

11. A fuel composition comprising a major amount of a normally liquid fuel and a minor intake valve deposit-inhibiting or valve stick performance-enhancing amount of an additive composition comprising:

(A) a polyisobutylene-substituted alkylene polyamine having a number average molecular weight of about 1000 to about 1500, wherein the alkylene polyamine is selected from the group consisting of ethylenediamine, diethylenetriamine, triethylenetetramine, tetraethylenepentamine, and pentaethylenehexamine and mixtures thereof; and (B) a hydrocarbyl-terminated poly(oxypropylene) monool represented by the formula

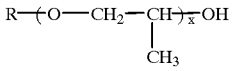
(B-I)
wherein R is an alkyl group of about 12 to about 16 carbon atoms, x is about 23 to about 25, wherein components (A) and (B) are each present at a level of about 50 to about 250 ppm based on the weight of the normally liquid fuel, and wherein the weight ratio of component (A) to component (B) is about 1:2 to about 2:1.
* * * * *